United States Patent [19]

Evans et al.

[11] 4,268,811

[45] May 19, 1981

[54] CIRCUIT INTERRUPTING DEVICE

[75] Inventors: David M. Evans, Palatine; Edward J. Rogers, Chicago, both of Ill.

[73] Assignee: S&C Electric Company, Chicago, Ill.

[21] Appl. No.: 660,872

[22] Filed: Feb. 24, 1976

[51] Int. Cl.[3] ..... H01H 71/20; H01H 85/20

[52] U.S. Cl. ..... 337/156; 200/144 R; 200/149 R; 337/169; 337/186

[58] Field of Search ..... 337/156, 169, 180, 186, 337/171, 174, 191; 200/144, 146 R, 149 R

[56] References Cited

U.S. PATENT DOCUMENTS

| | | | |
|---|---|---|---|
| 2,223,731 | 12/1940 | Lingal . | |
| 2,262,386 | 11/1941 | Crabbs . | |
| 2,308,026 | 1/1943 | Rawlins . | |
| 2,317,118 | 4/1943 | Schultz et al. . | |
| 2,337,889 | 12/1943 | Harlow et al. . | |
| 2,469,203 | 5/1949 | Palme et al. . | |
| 2,480,622 | 8/1949 | Warnock . | |
| 2,716,681 | 8/1955 | Smith, Jr. | 337/169 X |
| 2,744,179 | 5/1956 | Schneider . | |
| 2,835,768 | 5/1958 | Mittelstadt . | |
| 2,951,924 | 9/1960 | Schultz | 337/169 |
| 3,005,891 | 10/1961 | Charewicz et al. | 337/180 X |
| 3,258,568 | 6/1966 | Patterson et al. | 200/149 R |
| 3,316,372 | 4/1967 | Bridges | 337/156 |

FOREIGN PATENT DOCUMENTS

| | | |
|---|---|---|
| 870774 | 5/1971 | Canada . |

*Primary Examiner*—Robert J. Hickey
*Attorney, Agent, or Firm*—John D. Kaufmann

[57] ABSTRACT

A circuit interrupting device is disclosed. A stationary contact is mounted within a stationary hollow insulator and connected to one side of an electrical circuit. A movable contact normally engages the stationary contact and is mounted for movement within the stationary hollow insulator. The movable contact is connected by a contact rod that extends through an opening in the insulator to a set of spring detent fingers. The spring detent fingers electrically and mechanically engage the end of a movable conductive element, such as a power fuse or disconnect switchblade, which is connected to the other side of the electrical circuit. A spring biases the movable contact toward engagement with the stationary contact. When the movable conductive element is moved away from the device, the spring detent fingers grip the element and cause the movable contact to move to disengage the stationary contact. The resultant arc is quickly extinguished by an arc extinguishing liner and trailer thereby interrupting current flow. The movable contact continues to move away from the stationary contact until the movable contact engages a limit stop within the hollow insulator. At this time, the spring detent fingers disengage the movable conductive element creating an air gap, and the spring returns the movable contact to engagement with the stationary contact. However, since the movable conductive element is now disengaged, current flow remains interrupted. A latch arrangement may be provided to latch the conductive element to the device to prevent accidental opening until the latch is manipulated by an operator.

31 Claims, 5 Drawing Figures

CIRCUIT INTERRUPTING DEVICE

BACKGROUND OF THE INVENTION

1. Field of the Invention

The present invention relates to high voltage circuit interrupting devices, and more particularly, the present invention relates to a compact interrupting device to be used in conjunction with movable conductive elements such as a power fuse or a disconnect switchblade.

2. Description of the Prior Art

Circuit interrupting devices are well known in the art for interrupting current flow in high voltage circuits. Because of the high voltage, a switch is totally unsuited for interrupting current flow in an electrical circuit. Upon opening of ordinary switch contacts, the high voltage causes an arc to be drawn between the separating contacts thereby resulting in the possibility of a short-circuit and consequent damage to the contacts and the surrounding structure. Further, the resultant arc may continue for a long time without interruption.

Accordingly, a variety of circuit interrupting devices have been developed to permit the interruption of current flow in high voltage circuits. For example, the switch contacts have been placed in a vacuum so that there is no gas capable of ionization and arc conduction. Further, prior art interrupter switches have been developed wherein the contacts are surrounded by an ambient atmosphere of an arc extinguishing gas. Further, prior art circuit interrupting devices have been developed utilizing a solid liner and trailer fabricated of a material that evolves an arc extinguishing gas when exposed to an electrical arc. Thus, when the contacts separate, the evolved gas causes the arc to be extinguished. Prior art constructions illustrating conventional prior art current interrupting switches utilizing such solid gas evolving trailer liner arrangements are illustrated in U.S. Pat. No. 3,236,984—Lindell and U.S. Pat. No. 3,792,215—Keto.

Prior to the development of the present invention, several attempts have been made to provide a simple, inexpensive circuit interrupting device that could be utilized in connection with movable conductive elements such as power fuses, cutout fuses, and disconnect switchblades to interrupt current flow during opening. For example, the device illustrated in U.S. Pat. Nos. 2,671,142; 2,671,145; 2,816,978; 2,816,980; 2,816,981; 2,816,983; and 2,816,985 all by Lindell and assigned to the same assignee as the present invention disclose a portable hand operated device known as a "Loadbuster" tool that may be used to open fuses, disconnect switches and other electrical elements under load. U.S. Pat. No. 3,235,696—Mikulecky discloses a load break disconnecting device that is permanently mounted to a disconnect switchblade and a central load break switch that includes a fuse. This device uses a solid nonconducting arc suppressing sleeve that slides over the conducting portions of the switchblade as the switch is opened to suppress the arc and interrupt current.

Despite the variety of circuit interrupting devices presently available, it would nonetheless be a desirable advantage in the art to provide a simple, inexpensive current interrupting device which may be permanently mounted and repeatably used in connection with movable conductive elements in series to interrupt current flow when those movable conductive elements are moved to an open position.

BRIEF DESCRIPTION OF THE INVENTION

A circuit interrupting device in accordance with the present invention comprises a stationary electrical contact connected to one side of an electrical circuit having a stationary hollow insulator mounted around the stationary contact with an opening at one end of the insulator. A movable electrical contact normally engages the stationary electrical contact and is mounted for movement within the insulator away from the stationary contact. Bias means are provided for biasing the movable contact towards engagement with the stationary contact. The movable electrical contact is connected to the other side of the electrical circuit. Release means are connected to the movable contact and extend through the opening in the insulator for releasably engaging a movable conductive element. Provided within the insulator are limit means for limiting the distance of travel of the movable contact when it is moved to a predetermined distance. Also, an arc extinguishing liner means is positioned adjacent the path of travel of the movable contact for extinguishing a resultant arc between the stationary and movable contacts.

Electrical current flow is interrupted when the movable element is moved to cause the movable contact to disengage the stationary contact and the resultant arc is extinguished by the arc extinguishing means. The movable contact moves until it engages the limit means thereby stopping the movement of the movable contact. When this occurs, the release means disengages the movable conductive element allowing an air gap to be created between the movable conductive element and the release means. The bias means then returns the movable contact back to engagement with the stationary contact, but since an air gap has now been established and elongated, current flow continues to be interrupted.

In the present invention, the movable conductive element can comprise a variety of different types of movable elements. For example, the movable element could be one of a variety of power fuses or disconnect switchblades or any movable element which is movable in a predetermined path. Further, the present invention may include a flange attached to the end of the insulator adjacent the movable conductive element, and latch and delatching means for normally engaging the flange but permitting disengagement upon operator manipulation.

Further, the release means may comprise a rod connected at one end to the movable contact and extending through the opening in the insulator, and spring biased fingers attached to the other end of the rod formed to disengageably grip the end of the movable conductive element.

Thus, it is a principal object of the present invention to provide a compact inexpensive circuit interrupting device for use in conjunction with movable conductive elements such as a power fuse or disconnect switchblade.

It is a further object of the present invention to provide a reusable circuit interrupting device which may be repeatedly used to interrupt current flow when a movable conductive element in a high voltage circuit is opened.

It is yet another object of the present invention to provide a latching arrangement which prevents accidental opening of the movable conductive element.

These and other objects, advantages, and features will hereinafter appear, and for the purposes of illustration but not of limitation, an exemplary embodiment of the present invention is hereinafter described and illustrated in the accompanying drawings.

DETAILED DESCRIPTION OF THE PREFERRED EMBODIMENT

Figure 1:
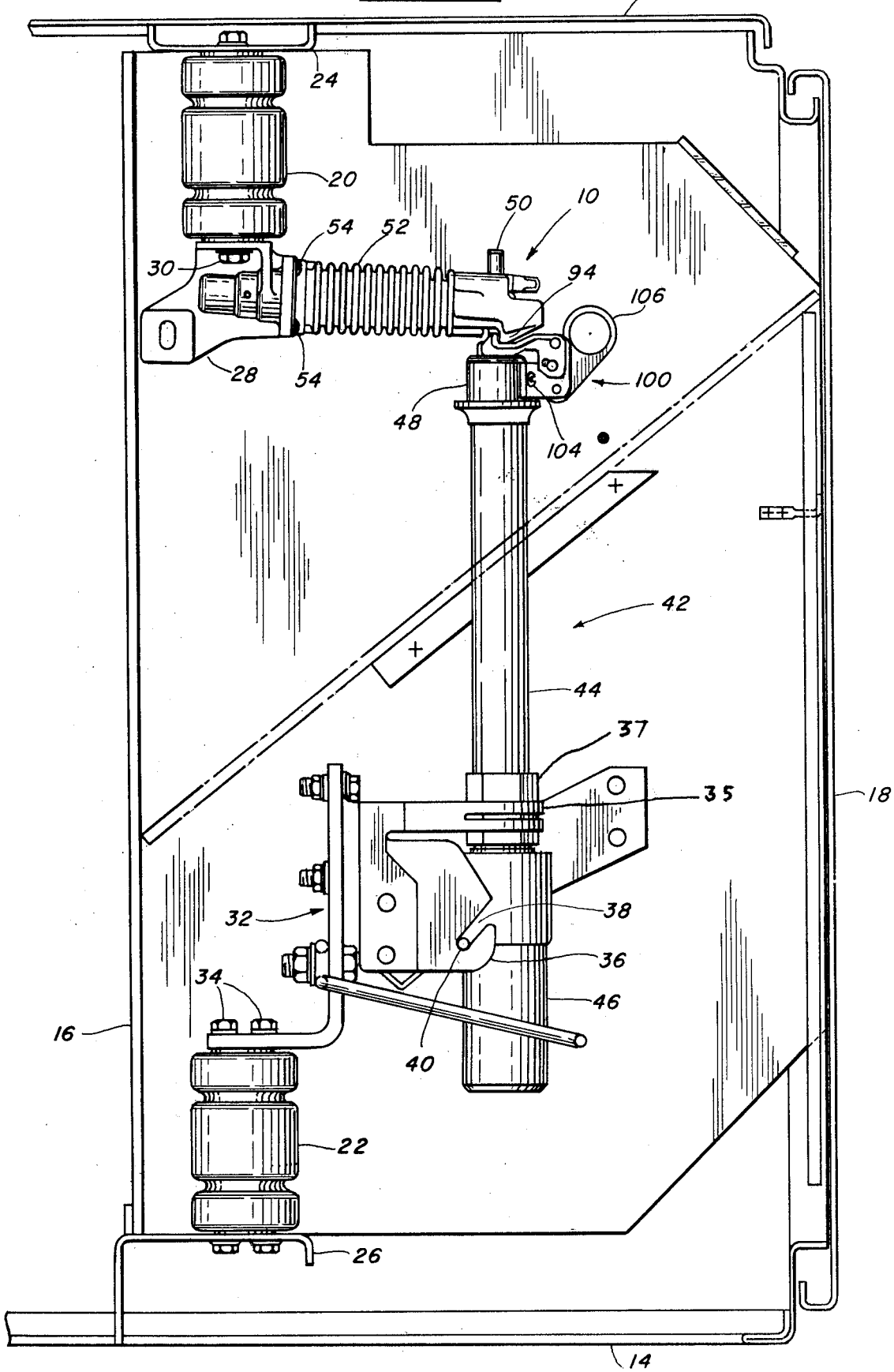
FIG. 1 is a partially fragmentary side elevational view of a preferred embodiment of the present invention.

With reference to FIG. 1, circuit interrupting device 10 is shown mounted in a portion of a metal enclosure comprising top wall 12, bottom wall 14, insulating barrier 16, and door 18. Insulators 20 and 22 are respectively mounted on flanges 24 and 26 which are respectively mounted on top wall 12 and bottom wall 14.

A contact adaptor 28 is mounted by bolts 30 to the end of insulator 20, and a fuse support assembly 32 is mounted on the end of insulator 22 by bolts 34. Contact adaptor 28 serves as a first circuit terminal and is connected to one side of an electrical circuit, and fuse support assembly 32 serves as a second circuit terminal and is connected to the other side of the electrical circuit. Fuse support assembly 32 comprises a pair of support plates 36, only one of which is shown, each having a slot 38 formed therein to receive a trunnion boss 40 attached to the end of fuse assembly 42, and lower contact fingers 35 adapted to engage lower metal ferrule 37 on fuse assembly 42. Fuse assembly 42 comprises a fuse body 44 and an exhaust control device 46 mounted to the ferrule 37 on the end of fuse body 44. Mounted on the opposite end of fuse body 44 is a metallic end ferrule 48 having a metallic contact rod 50 attached thereto. Fuse assembly 42 is adapted to pivot in a clockwise direction as viewed in FIG. 1 around trunnion boss 40 in slot 38.

Figure 2:
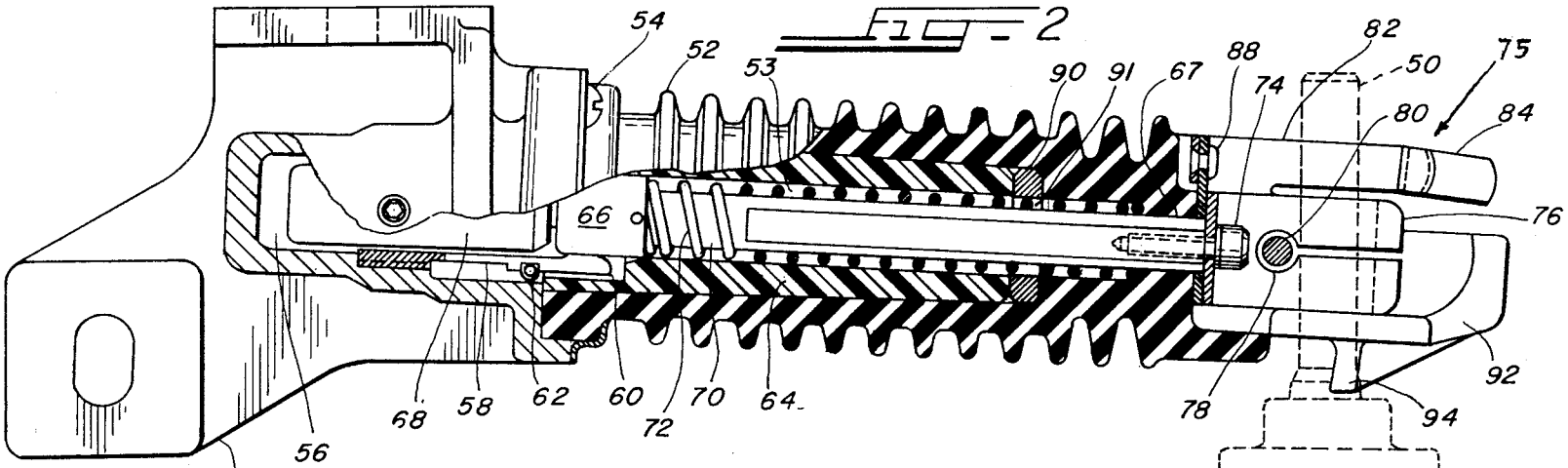
FIG. 2 is a side partially cross-sectional view of a portion of the preferred embodiment illustrated in FIG. 1.
Figure 3:
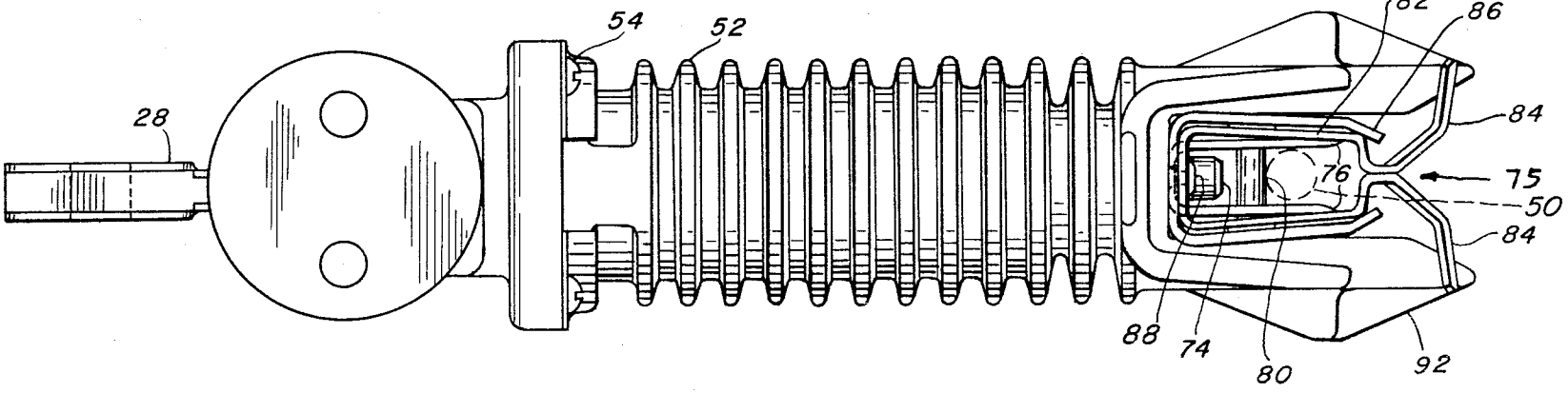
FIG. 3 is a top view of the structure illustrated in FIG. 2.

With reference to FIGS. 1 and 2, a hollow insulator 52 is mounted to contact adaptor 28 by screws 54. Formed in contact adaptor 28 is a hollow portion 56 that communicates with the hollow interior 53 of insulator 52. Mounted within the hollow portion 56 of and electrically connected to contact adaptor 28 is stationary contact 58. Stationary contact 58 comprises contact fingers 60 that are biased toward one another by garter spring 62.

Mounted adjacent stationary contact 58 and along the hollow interior 53 of insulator 52 is arc extinguishing sleeve 64 that is fabricated of a material that produces an arc extinguishing gas when exposed to an electrical arc. A variety of such arc extinguishing materials are well known in the art.

A movable conductive contact 66 is normally positioned in engagement with stationary contact 58. Mounted to the end of movable electrical contact 66 is an arc extinguishing trailer 68 also formed of a material that produces an arc extinguishing gas when exposed to an electrical arc. A contact rod 70 is attached at one end to moving contact 66 and extends through the hollow interior 53 of insulator 52 through an opening 67 in the end thereof. Opening 67 is dimensioned to provide a sliding fit with contact rod 70. A spring 72 is positioned around contact rod 70 and is compressed between movable contact 66 and the end of hollow interior 53 to exert force against movable contact 66 to bias movable contact 66 toward engagement with stationary contacts 58.

Mounted to the end of contact rod 70 by a bolt 74 is spring contact assembly 75 comprising spring contact 76 and gripping spring 82. Mounted through a circular opening 78 in spring contact 76 is pin 80. Gripping spring 82 comprises fingers 84 which are formed to expand to allow contact rod 50 to move between fingers 84. An additional spring 86 is positioned around fingers 84 and attached to gripping spring 82 by rivet 88 to provide additional bias force on fingers 84 to cause them to be urged together. Spring contact 76 provides continuous current carrying capacity for the current flowing in the circuit.

Positioned within insulator 52 is an annular limit stop ring 90 that has a central opening 91 that is dimensioned slightly larger than contact rod 70 and slightly smaller than movable contact 66 so that movable contact 66 will engage stop ring 90 when moved towards the right as viewed in FIG. 2.

Formed on the end of insulator 52 are guide fingers 92 that act to guide the end of contact rod 50 into proper engagement with spring contact assembly 75. Formed on the bottom of guide fingers 92 are latch flanges 94 (only one of which is shown) for engaging with a latch assembly 100.

Figure 4:
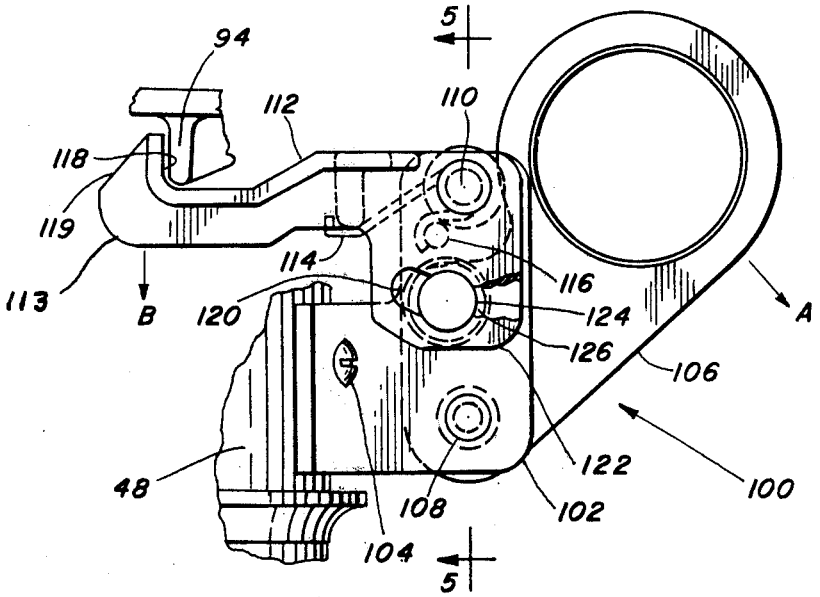
FIG. 4 is a side view of the latch arrangement in accordance with the present invention.
Figure 5:
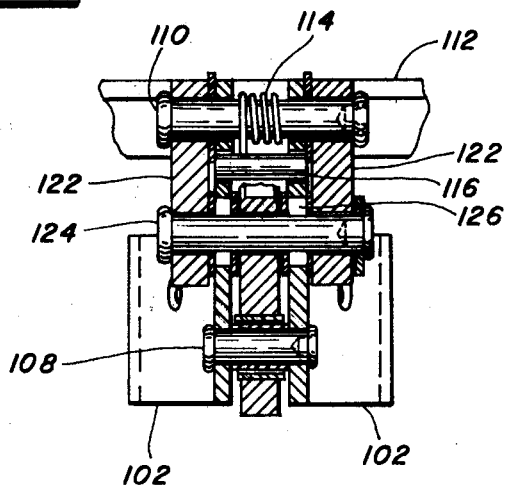
FIG. 5 is a cross-sectional view taken substantially along line 5—5 in FIG. 4.

With reference to FIGS. 1, 4, and 5, latch assembly 100 comprises bearing plates 102 attached to end ferrule 48 by screws 104. A pull ring 106 is pivotally mounted by a pin 108 rivetted through an opening in the bottom of bearing plates 102. Pivotally mounted by pin 110 through a circular opening in the top of bearing plates 102 is latch 112 having a pair of ends 113 (only one of which is shown). Positioned around pin 110 is spring 114, one end of which is retained by pin 116 and the other end of which engages the bottom of latch 112 causing latch 112 to be urged in a clockwise direction about pin 110 as viewed in FIG. 4. Formed on the ends 113 of latch 112 are engaging surfaces 118. A slot 120 is formed through the vertically disposed legs 122 of latch 112. A pin 124 extends through slot 120 and also extends through circular openings 126 in bearing plates 102 and through a circular opening in pull ring 106. Circular openings 126 are substantially larger than pin 124 so that pin 124 can move laterally within circular openings 126.

Engaging surfaces 118 of latch 112 normally engage flanges 94 on insulator 52. When pull ring 106 is pulled by an insulated hook stick substantially in the direction of arrow A in FIG. 4, pull ring 106 is pivoted about pin 108 causing pin 124 to engage the end of slot 120 causing latch 112 to pivot in the direction of arrow B around pin 110. This causes engaging surfaces 118 to disengage flanges 94 allowing fuse assembly 42 to pivot around trunnion boss 40 in slot 38 on support plates 36 (see FIG. 1). As fuse assembly 42 pivots, fingers 84 engage rod 50 causing contact rod 70 and movable contact 66 to move towards the right as viewed in FIG. 2. This motion causes movable contact 66 to disengage stationary contact 58. Since stationary contact 58 is electrically connected to the first circuit terminal, namely contact adaptor 28 which is connected to one side of the electrical circuit, and since rod 50 is electrically connected through fuse assembly 42, contact fingers 35, and the second circuit terminal, namely fuse support assembly 32, to the other side of the electrical circuit, an electrical arc is created when stationary contact 58 and movable contact 66 disengage. However, arc extinguishing sleeve 64 and arc extinguishing trailer 68 are in direct proximity to the arc thereby generating an arc extinguishing gas which quickly acts to extinguish the arc to interrupt current flow.

Movable contact 66 continues to move through the hollow interior 53 of insulator 52 as fuse assembly 42 is pivoted until movable contact 66 engages stop ring 90. At this time, the continued movement of fuse assembly 42 causes fingers 84 to separate allowing rod 50 to slip between fingers 84 thereby releasing rod 50 from fingers 84. Once fingers 84 have released rod 50, spring 72 exerts a bias force to cause movable contact 66 to return to engagement with stationary contact 58 in the position illustrated in FIG. 2. However, since an air gap has been created between the end of spring contact assembly 75 and rod 50, current will continue to be interrupted. Thus, current flow is effectively interrupted by pivoting fuse assembly 42 in the manner described.

With fuse assembly 42 removed from the electrical circuit, fuse assembly 42 may be left open and supported by fuse support assembly 32, as if it were an open switchblade, or it may be removed from fuse support assembly 32 to permit maintenance or to guarantee against inadvertent circuit closure.

To return fuse assembly 42 into the electrical circuit, trunnion boss 40 is inserted into slot 38 and fuse assembly 42 is pivoted rapidly in a counterclockwise direction (as viewed in FIG. 1) by use of an insulated hook stick. High closing speed is desirable since movable contact 66 has been returned to engagement with stationary contact 58 so that a prestrike arc will form between contact rod 50 and spring contact 76 and fingers 84 as they are brought together.

Fingers 84 are formed to guide rod 50 and to spread apart as rod 50 is returned to engagement. Pin 80 acts as a stop to prevent contact rod 50 from striking insulator 52 or bolt 74 when fuse assembly 42 is pivoted back into engagement. Fingers 84 are also arranged and adapted so that the pre-strike arc occuring upon closing forms between rod 50 and Fingers 84. Thus, the portion of rod 50 which engages contacts 76 is not damaged by the arc, and the continuous current carrying capacity of contacts 76 and the engaging portion of rod 50 is not impaired.

Latch 112 has slanted surfaces 119 on the ends 113 thereof which engage the front edge of latch flanges 94 to cause latch 112 to pivot downwardly in the direction of arrow B as the fuse assembly 42 is moved back into the circuit. Slot 120 allows latch 112 to pivot without binding against pin 124. Spring 114 biases latch 112 upwardly so that engaging surfaces 118 will engage flanges 94 thereby latching the fuse assembly 42 in position ready for the next operation.

It should be expressly understood that various changes, variations, and modifications may be made to the structure of the present embodiment without departing from the spirit and scope of the present invention as set forth in the appended claims. For example, in the present embodiment, the present invention is shown in connection with a fuse. However, the present invention is equally applicable to a variety of movable conductive elements such as disconnect blades and other types of movable switching elements. Further, it is not necessary that the movable electrical element be pivotally mounted. The present invention will work equally well with linearly moving switching elements whether they be fuse assemblies, blades, or the like. In addition, it is not necessary that the circuit interrupter be stationarily mounted, and it also may be movable.

We claim:

1. A device for interrupting electrical current comprising:

circuit interrupting means for interrupting electrical current electrically connected to a first circuit terminal;

a movable conductive element electrically connected to a second circuit terminal; and gripping contact means on said circuit interrupting means for releasably gripping said movable conductive element to electrically serially connect said movable conductive element to said circuit interrupting means so that movement of said movable conductive element away from said circuit interrupting means causes said circuit interrupting means to interrupt current between said first and second circuit terminals before said gripping contact means releases said movable conductive element, said gripping contact means and said circuit interrupting means constituting the exclusive conductive path between said movable conductive element and said first terminal.

2. A device, as claimed in claim 1, wherein said movable conductive element comprises a fuse.

3. A device, as claimed in claim 1, further comprising latch means for releasably latching said movable conductive element to said circuit interrupting means.

4. A device, as claimed in claim 1, wherein;

said circuit interrupting means comprises:

a stationary electrical contact electrically connected to said first circuit terminal;

a stationary hollow insulator mounted coaxially with said stationary contact having an opening therein;

a movable electrical contact normally engaging said stationary electrical contact and mounted for movement within said insulator away from said stationary contact; and arc extinguishing means for extinguishing arcs between said stationary and movable contacts; and said gripping contact means comprises:

a rod connected at one end to said movable contact and extending through said opening in said insulator; and at least one flexible member attached to the other end of said rod formed to disengageably grip the end of said movable conductive element.

5. A device, as claimed in claim 4, further comprising a resilient means for biasing said movable electrical contact toward engagement with said stationary electrical contact.

6. A circuit interrupting device comprising:

a stationary electrical contact connected to a first circuit terminal;

a stationary hollow insulator mounted coaxially with said stationary contact having an opening at one end thereof;

a movable electrical contact normally engaging said stationary electrical contact and mounted for movement within said insulator away from said stationary contact;

bias means for urging said movable contact toward engagement with said stationary contact;

a movable conductive element serially connected to a second circuit terminal;

release means connected to said movable contact and extending through said opening in said insulator for disengageably engaging said movable conductive element to serially electrically connect said first circuit terminal with said second terminal;

arc extinguishing means for extinguishing arcs between said stationary and movable contacts;

whereby current flow is serially interrupted when said movable conductive element is moved to cause said movable contact to disengage said stationary contact so that the resultant arc is extinguished by said arc extinguishing means, said movable contact continuing to move until said release means disengages from said movable conductive element thereby allowing said bias means to return said movable contact to engagement with said stationary contact.

7. A circuit interrupting device, as claimed in claim 6, wherein said movable conductive element is a pivotally mounted fuse.

8. A circuit interrupting device, as claimed in claim 6, further comprising limit means for limiting the distance of travel of said movable contact.

9. A circuit interrupting device, as claimed in claim 6, wherein said bias means is a spring.

10. A circuit interrupting device, as claimed in claim 6, wherein said release means comprises:

a rod connected at one end to said movable contact and extending through said opening in said insulator; and spring biased fingers attached to the other end of said rod formed to disengageably grip the end of said movable conductive element.

11. A circuit interrupting device, as claimed in claim 7, further comprising:

a flange connected to the end of said insulator adjacent said fuse;

latch means attached to said fuse for engaging said flange;

delatching means associated with said latch means for disengaging said latch means from said flange in response to operator manipulation.

12. A circuit interrupting device, as claimed in claim 6, further comprising:

a flange attached to the insulator adjacent said movable electrical element;

latch means attached to said movable conductive element for engaging said flange;

delatching means associated with said latch means for disengaging said latch means from said flange in response to operator manipulation.

13. A device for interrupting and closing an electrical circuit in a series circuit relationship comprising:

a first electrically conductive element connected to a first circuit terminal and a second electrically conductive element connected to a second terminal, a first set of separable contacts arranged to serially electrically connect said first and second electrically conductive elements between the terminals, said electrically conductive elements being mounted for relative movement together or apart along a pre-determined path, said first electrically conductive element comprising a second set of separable contacts, said first and said second sets of separable contacts being serially arranged for sequential operation so that when said relative movement of said electrically conductive elements is apart, the series circuit is interrupted by the separation of said second set of separable contacts followed by separation of said first set of separable contacts, and when said relative movement of said elements is together, a series circuit is completed at said first set of separable contacts, there being no other electrical connection between said second conductive element and said first terminal when said conductive elements are serially connected by both sets of said separable contacts so that said conductive elements carry the same current in all relative positions of said conductive elements.

14. A device, as claimed in claim 13, wherein said second set of separable contacts includes a stationary contact fixed with respect to said first electrically conductive element and a movable contact biased towards said stationary contact by a resilient means.

15. A device, as claimed in claim 14, wherein said first set of separable contacts comprises first and second engaging means, said first engaging means being a part of said first electrically conductive element, and said second engaging means being a part of said second electrically conductive element.

16. A device, as claimed in claim 15, wherein said movable contact is operatively connected to said first engaging means, said first engaging means being releasably engageable with said second engaging means.

17. A device, as claimed in claim 16, wherein when the first and second electrically conductive elements are moved apart, said first engaging means remains engaged with said second engaging means so that said movable contact is separated from said stationary contact to interrupt the series electrical circuit.

18. A device, as claimed in claim 13, further comprising releaseable latch means for preventing said first and said second electrically conductive elements from moving apart until said latch means is released by operator manipulation.

19. A device, as claimed in claim 13, wherein said second electrically conductive element is a fuse.

20. A device as in claim 13, wherein said second electrically conductive element is a rigid body.

21. A device, as claimed in claim 18, wherein said latch means further comprises pullring means for releasing said latch means and affecting separation of said first and second electrically conductive elements.

22. In a device for interrupting and closing an electrical circuit having relatively movable first and second electrically conductive elements, means for releaseably preventing relative separation of said first and second electrically conductive elements comprising:

engaging means on the first of said electrically conductive elements, said engaging means being relatively fixed with respect to said first element;

latch means mounted for rotation on a first pivot attached to said second electrically conductive element, said latch means positioned to achieve a latching relationship with said engaging means;

resilient means biasing said latch means for rotation in a latching direction;

stop means on said second electrically conductive element to limit rotation of said latch means in the latching direction;

pull-ring means mounted for rotation on a second pivot attached to said second electrically conductive element;

coupling means joining said latch means and said pull-ring means, whereby rotation of said pull-ring means by a force applied to said pull-ring means to effect separation of said first and said second electrically conductive elements will cause a rotation of said latch means to disengage said engaging means to permit separation of said first and second electrically conductive elements, and whereby said coupling means permits said latch means to rotate for engagement with said engaging means without causing corresponding rotation of said pull-ring means when a force is applied to said pull-ring means to affect closing of said first and second electrically conductive elements.

23. A device, as claimed in claim 22, wherein rotation of said pull-ring means in a first direction causes said latch means to rotate in an opposite direction.

24. A device, as claimed in claim 23, wherein said coupling means is positioned essentially between said first and second pivots.

25. A device, as claimed in claim 22, wherein said resilient means is a spring.

26. An apparatus for mounting a fuse comprising:

first and second circuit terminals in an insulated spaced relation;

hinge means connected to the second circuit terminal for supporting a fuse having first and second ends for rotation about its first end;

current interrupting means connected to said first circuit terminal, said current interrupting means including a housing, external contact means outside of the housing adapted for serial engagement with the second end of said fuse, said stationary current interrupting means also including internal separable contacts within the housing serially arranged between said first circuit terminal and said external contact means;

said current interrupting means and said fuse being in a series electrical circuit relationship between said first and second terminals, there being no other electrical connection between said second fuse end and said first terminal when said contact means engage said second fuse end so that said interrupting means and said fuse carry the same current in all rotational positions of said fuse.

27. An apparatus, as claimed in claim 26, wherein said external contact means include releaseable gripping means for engaging the second end of said fuse, whereby manipulation of said fuse away from said current interrupting means causes separation of said internal separable contacts to interrupt said series electrical circuit.

28. Fuse mounting means as claimed in claim 26, wherein said fuse comprises a conductive element that will carry a full range of fault currents without fusing.

29. An improved electrical current interrupting device for use with a circuit switching element, the device and the switching element being relatively movable between a circuit closed position and a circuit opened position; the device being of the type which includes a movable contact normally engaging a stationary contact and movable relative thereto in an arc extinguishing environment; the stationary contact being connectable to a first circuit terminal; the switching element being connectable to a second terminal; wherein the improvement comprises:

means for normally electrically connecting the movable contact in series with the switching element between the terminals and for disengaging the movable contact from the stationary contact in response to relative movement of the device and the switching element toward the circuit opened position; and means for disconnecting the movable contact from the switching element after the movable contact has moved a predetermined distance away from the stationary contact, there being no other electrical connection between the switching element and the first circuit terminal in the circuit closed position so that the switching element and the interrupting device carry the same current in the circuit closed position.

30. The device of claim 29 wherein the connecting means comprises fingers attached to the movable contact and engageable with the switching element; and the disconnecting means comprises:

stop means for limiting the movement of the movable contact; and resilient means for permitting disengagement of the switching element from the fingers in response to movement limitation of the movable contact by the stop means.

31. The device of claim 30 which further includes resilient means for continuously biasing the movable contact toward engagement with the stationary contact.

* * * * *

UNITED STATES PATENT AND TRADEMARK OFFICE

CERTIFICATE OF CORRECTION

PATENT NO. : 4,268,811

DATED : May 19, 1981

INVENTOR(S) : David M. Evans and Edward J. Rogers

It is certified that error appears in the above—identified patent and that said Letters Patent is hereby corrected as shown below:

In Claim 26 (Column 9)

Line 27, cancel "having" and insert -- which has --;

Line 27, after "ends" insert -- and is manipulable --;

Line 29, after "means" insert -- stationary relative to said fuse and --;

Line 32, cancel "adapted";

Line 32, cancel "serial engagement" and insert -- serially engaging --;

Line 33, cancel "with";

Line 33, after "fuse" insert -- when said fuse is rotated toward said current interrupting means and for disengaging the second end of said fuse when said fuse is rotated away from said current interrupting means --;

Line 33, cancel "stationary".

Signed and Sealed this

*Twenty-ninth* Day of *December 1981*

[SEAL]

*Attest:*

GERALD J. MOSSINGHOFF

*Attesting Officer*

*Commissioner of Patents and Trademarks*